US009884323B2

(12) United States Patent
Chang

(10) Patent No.: US 9,884,323 B2
(45) Date of Patent: Feb. 6, 2018

(54) PAPER SHREDDER HAVING INTERCHANGEABLE FEED BELT CARTRIDGES

(71) Applicant: Intek America, Inc., Rancho Dominguez, CA (US)

(72) Inventor: Herman Chang, Rancho Dominguez, CA (US)

(73) Assignee: Intek America, Inc., Rancho Dominguez, CA (US)

( * ) Notice: Subject to any disclaimer, the term of this patent is extended or adjusted under 35 U.S.C. 154(b) by 0 days.

(21) Appl. No.: 15/138,940

(22) Filed: Apr. 26, 2016

(65) Prior Publication Data

US 2016/0318031 A1 Nov. 3, 2016

Related U.S. Application Data

(60) Provisional application No. 62/153,991, filed on Apr. 28, 2015.

(51) Int. Cl.
*B02C 18/22* (2006.01)
*B02C 18/00* (2006.01)

(52) U.S. Cl.
CPC ..... *B02C 18/2241* (2013.01); *B02C 18/0007* (2013.01)

(58) Field of Classification Search
CPC ..... B02C 18/22411; B02C 18/0007
USPC ..... 241/225
See application file for complete search history.

(56) References Cited

U.S. PATENT DOCUMENTS

2011/0303775 A1* 12/2011 Kim ..... B02C 18/0007 241/34
2012/0223169 A1* 9/2012 Pan ..... B02C 18/0007 241/101.2
2013/0161424 A1* 6/2013 Pan ..... B02C 18/0007 241/34
2014/0061347 A1* 3/2014 Chang ..... B02C 18/0007 241/282.1

* cited by examiner

*Primary Examiner* — Shelley Self
*Assistant Examiner* — Joseph Finan, Jr.
(74) *Attorney, Agent, or Firm* — Stefan J. Kirchanski; Matthew J. Spark; Zuber Lawler & Del Duca LLP

(57) ABSTRACT

An auto-feed paper shredder operates by using counter-rotating belts to grasp sheets of paper from the bottom of a stack of paper and push the sheet into a shredding mechanism. Successive sheets are pulled from the stack and shredded so that an entire stack of several hundred sheets can be shredded without operator intervention. The belts that accomplish the auto-feeding are housed in roller belt assemblies that can be easily removed from and reinserted into the paper shredder. In this way when the belts become worn and no longer effectively grasp the paper, the user simply removes the assembly and inserts a new one. The worn assemblies can be returned to the manufacturer to be refurbished.

6 Claims, 8 Drawing Sheets

PAPER SHREDDER HAVING INTERCHANGEABLE FEED BELT CARTRIDGES

CROSS-REFERENCE TO PRIOR APPLICATIONS

The present application is based on and claims priority and benefit from U.S. Provisional Patent Application Ser. No. 62/153,991 filed on 28 Apr. 2015.

U.S. GOVERNMENT SUPPORT

Not Applicable

BACKGROUND OF THE INVENTION

Area of the Art

The present invention concerns paper shredders and more particularly a paper shredder with an auto-feed mechanism with user replaceable parts.

Description of the Background of the Invention

Modern paper shredders for shredding documents incorporate counter rotating shafts bearing blades and spacers so that paper passing between the blades is effectively shredded. The maximum sheet capacity of such paper shredders is dependent on the strength of the motor and the limitations of the cutting blades and rotary shafts. Although many units can handle small stacks of 10-20 sheets, when a large amount of paper must be destroyed, the user needs to stand beside the unit and continuously feed the machine stacks of paper that are within the maximum sheet capacity of the unit. If even a relatively small number of sheets are to be shredded, it is usually necessary for the user to get up and walk to the shredder because most units must be fed relatively small quantities of paper at one time—that is, they cannot shred large stacks of paper.

The problem of conveniently shredding large stacks can be solved by paper shredders equipped with some type of an auto-feed mechanism that allows automatic feeding of the paper shredder from large stacks of documents. U.S. Pat. No. 5,362,002, the contents of which are incorporated herein by reference, discloses a paper shredder with such an automatic paper feeding device. The feeding device includes an angled tray which is mounted to the device's top adjacent the shredding roller assembly, a rotary shaft which is mounted rotatably on the tray, a tension spring which is connected to the rotary shaft and the tray, and at least one push rod, which has two pivotally connected rod sections. The device operates by lifting one or a few sheets of paper from the top of the paper stack in the tray and transferring them into the throat of the shredder. A similar arrangement is found in U.S. Pat. No. 5,884,855, also incorporated herein by reference, which discloses a paper feed structure for paper shredders having a paper containing tray and paper feed adjustment device. Both of these auto-feeding devices simulate manual feeding of paper into a shredder and both of them depend on an external tray which increases the overall height and profile of the unit.

What is really needed is a shredder with an integral auto-feed system. A good example is disclosed in U.S. Pat. No. 8,074,912, the content of which is incorporated herein by reference, wherein the paper shredder includes a driving roller assembly at the bottom of a paper compartment and a hinged top for closing the paper compartment and providing downward pressure on the stack of paper located within the compartment. The driving roller assembly includes a spaced apart pair of counter rotating feed rollers which extend through an opening in the bottom of the paper compartment to contact and grab a sheet of paper from the bottom of a stack of paper that has been placed in the compartment. The sheet is grabbed near its center and pulled between the rollers and then pushed into the shredding mechanism. When the compartment is empty, one or more sheets of paper can be pushed through a slot in the hinged top directly between the feeding rollers and into the shredding mechanism. Thus, this unit can function either as an auto-feed unit which shreds a large stack of sheets placed in the compartment or, when the compartment is empty, as a conventional paper shredder by inserting sheets directly into the shredding mechanism.

As long as the hinged top is designed to provide the proper amount of pressure to the stack, the bottom feeding roller pair works quite well. However, one problem with the feed rollers is that each roller has only a single point of contact with the bottom of the paper stack. If this contact proves inadequate to pull a sheet of paper from the bottom of the stack, the whole system fails. Such a failure occurs if the rollers become worn so that they can no longer "grab" the contacting sheet of paper. The same thing may happen if there is a "slippery" spot on the lower side of the bottom sheet of paper.

SUMMARY OF THE INVENTION

The juxtaposed counter rotating rollers of a conventional auto-feeding paper shredder can effectively be replaced by short "conveyor" belts that are operated so as to move towards each other. The unit consists of a shredding mechanism disposed above a waste container. The shredding mechanism has a shredding compartment into which a large stack (e.g., several hundred sheets) of paper can be placed. The shredding compartment is closed by a hinged lid or door equipped with a pressure plate to apply pressure to the upper surface of a stack of papers that has been placed into the shredding compartment. There is also a feed slot located at the middle of the bottom of the shredding compartment; the feed slot aligns with the blades of a conventional paper shredding mechanism located below the feed slot. This slot is also in alignment with a slot through the lid so that if no papers occupy the compartment, one or a small number of sheets of can be inserted directly into the shredding mechanism as in a normal paper shredder without auto-feed functions.

There are three or four aligned conveyor belts on either side of the feed slot. These belts are formed from a flexible rubberized material which strongly interacts with paper in a frictional manner. When the shredder operated, the left-hand belts move towards the right and the right-hand belts move towards the left. When these belts contact the bottom of a stack of paper placed in the compartment, the counter motions of the belts causes the bottom sheet of paper to fold right above the feed slot so that the fold is pushed by the belts into the shredding mechanism below. Each successive sheet is pushed into the shredding mechanism until the entire stack of paper has been shredded. In a preferred embodiment the belts are driven by a drive train wherein a motor powers both the rotating blades of the shredding mechanism. However, it is also possible to provide a separate motor that powers only the belts.

The inventor has found that belts provide better and more reliable contact with the paper sheets so that the auto-feed is superior to counter rotating rollers. However, belts like rollers wear and eventually lose the ability reliably to grip paper. It is possible to send a repair technician to replace the worn belts; however, the present auto-feed shredders are relatively low-priced consumer products. Consumers resist the use of service calls either by a technician visiting the home or by dragging the unit into a service center. The belts themselves are relatively low cost items, but the complexity of disassembling the mechanism to replace the belts is beyond the technical ability and patience of most consumers.

The inventor has solved his problem by encasing the belts in a frame to constitute a removable belt cartridge unit. This unit consists of a frame containing mounted drive wheels or rollers over which the belts move in a manner analogous to tracks of a military tank (armored vehicle) moving over the tank's drive wheels. The drive wheels are equipped with a simple mechanical linkage such as frictional contact or a spline linkage or other mechanical linkage so that the belts automatically connect to the drive motor of the shredder when the belt cartridge is inserted into position. A simple locking mechanism makes it easy to remove one cartridge and drop in a replacement unit. It will be appreciated that while the drawings shows four pairs of belts, a greater or lesser number of belts can be employed. The replacement cartridge can consist of all the belts in the system. Or the belts can each have their own cartridge or all the belts on one side of the feed slot can be contained in a single cartridge so that two cartridges represent a complete replacement of the belts.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an auto-feed paper shredder with user replaceable drive belts.

Figure 1:
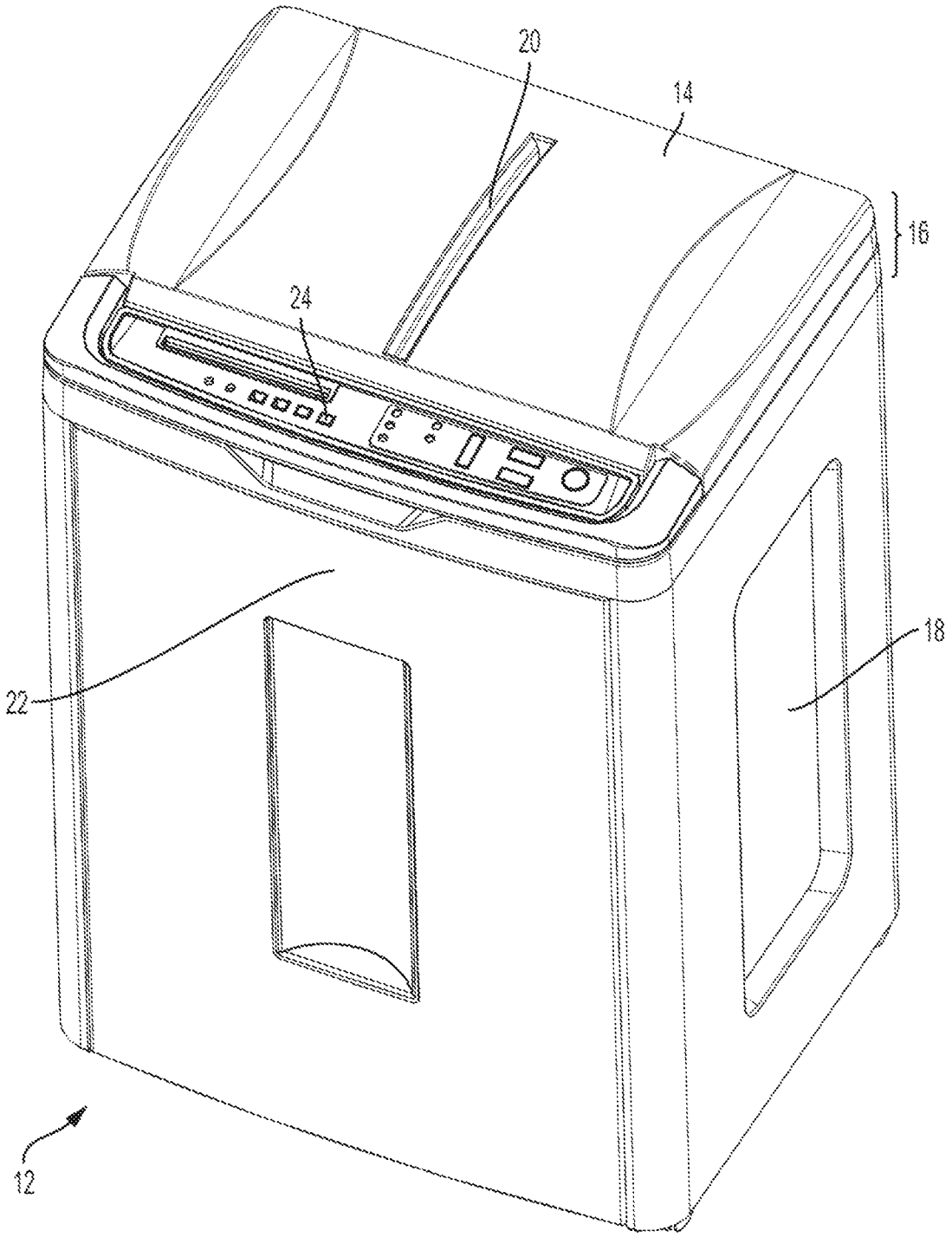
FIG. 1 is a drawing of the inventive paper shredder with the lid closed.

FIG. 1 shows the inventive shredder 12 which consists of a shredder component 16 which sits on top of an enclosure 18. The shredder component 16 has a lid 14 and a control panel 24 including various on and off controls. The lid 14 also has an input slot 20. Generally, the shredder component 16 is attached to the enclosure 18 by clips, screws or other mechanical fasteners although because the shredder component 16 includes a motor, it is fairly heavy and may simply rest on the enclosure 16 held in place by gravity. The enclosure 16 is largely hollow and most or all of the interior volume is a waste bin to catch the shredded paper bits exiting the shredding mechanism. The waste bin (not shown) can be accessed by way of a door 22.

Figure 2:
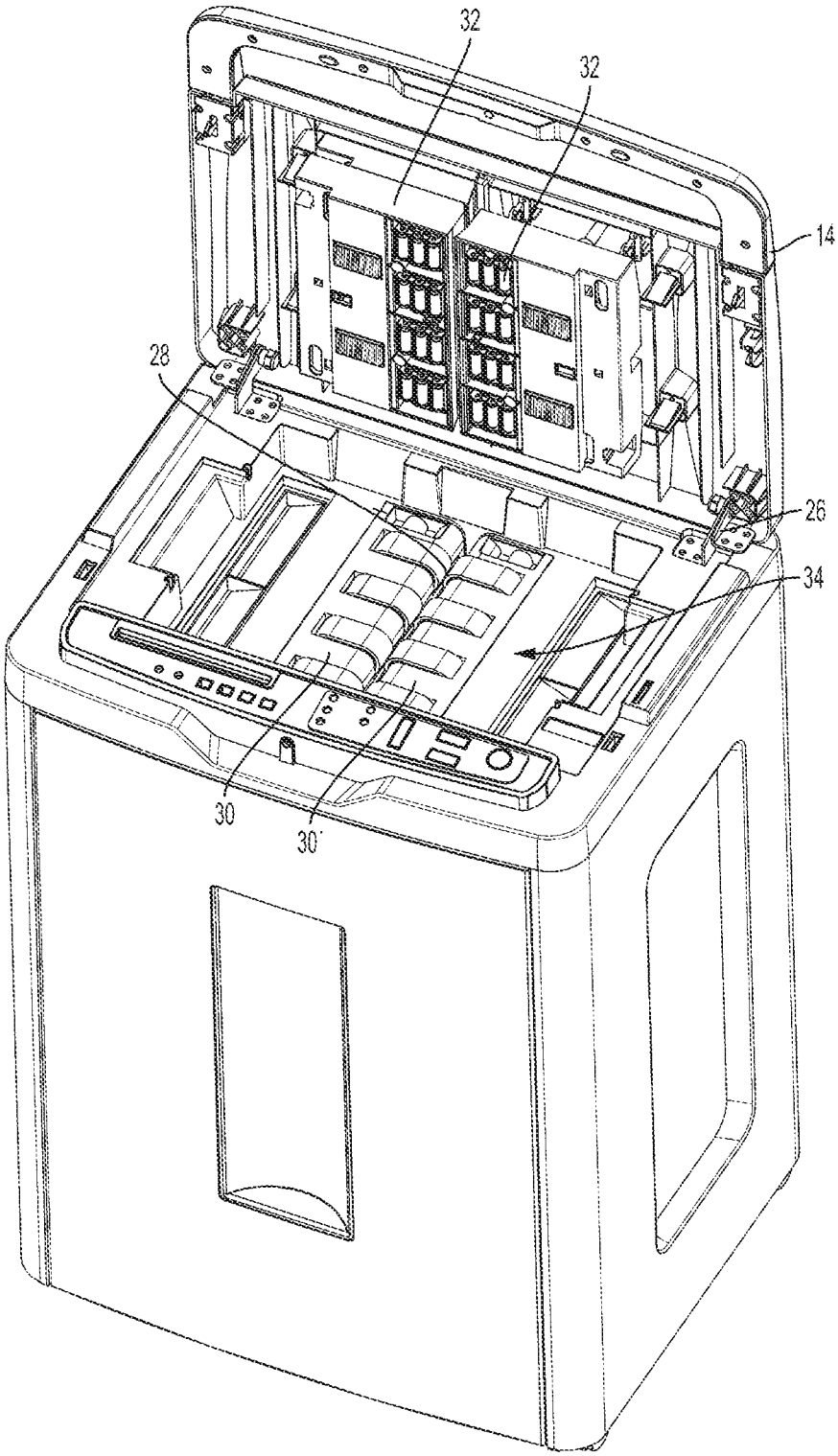
FIG. 2 is a drawing of the paper shredder of FIG. 1 with the lid open.

FIG. 2 shows the lid 14 in an opened configuration. The lid 14 is supported by hinges 26. When the lid 14 is open, a rectangular compartment 34 is revealed. This compartment 34 is sized to hold a stack of standard sized paper. In the middle of the compartment 34 a shredder mouth 28 is revealed. Any sheet of paper inserted into the mouth 28 will activate a shredder mechanism beneath the mouth 28 and the sheet will be shredded by rotating blades with the resulting paper fragments falling into the waste bin. The underside of the lid 14 carries two pressure plates 32 which exert pressure on the stack when the lid is closed. The input slot 20 is continuous with the gap between the two pressure plates 32. When the lid 14 is closed the input slot 20 aligns with the mouth 28 so that if there is no stack of paper in the compartment 34, sheets of paper can be fed directly from the outside and into the shredder mouth 28.

Roller belt assemblies 30, 30' are located on either side of the mouth 28. Each assembly has four belts, but as mentioned above, the number of belts can vary considerably depending on the width of the belts, etc. The belts in the left-hand assembly 30 are driven by rollers that rotate clockwise so that the belts move from the left end of the compartment 34 towards the mouth 28. The belts in the right-hand assembly 30' are driven by rollers that rotate counterclockwise so that the belts move from the right end of the compartment 34 towards the mouth 28. This arrangement grips the bottom sheet of a stack of paper pinching it into a fold which is drawn into the mouth 28 so that the bottom sheet of the stack is shredded. Then the new bottom sheet is grabbed and shredded and so on.

Figure 3:
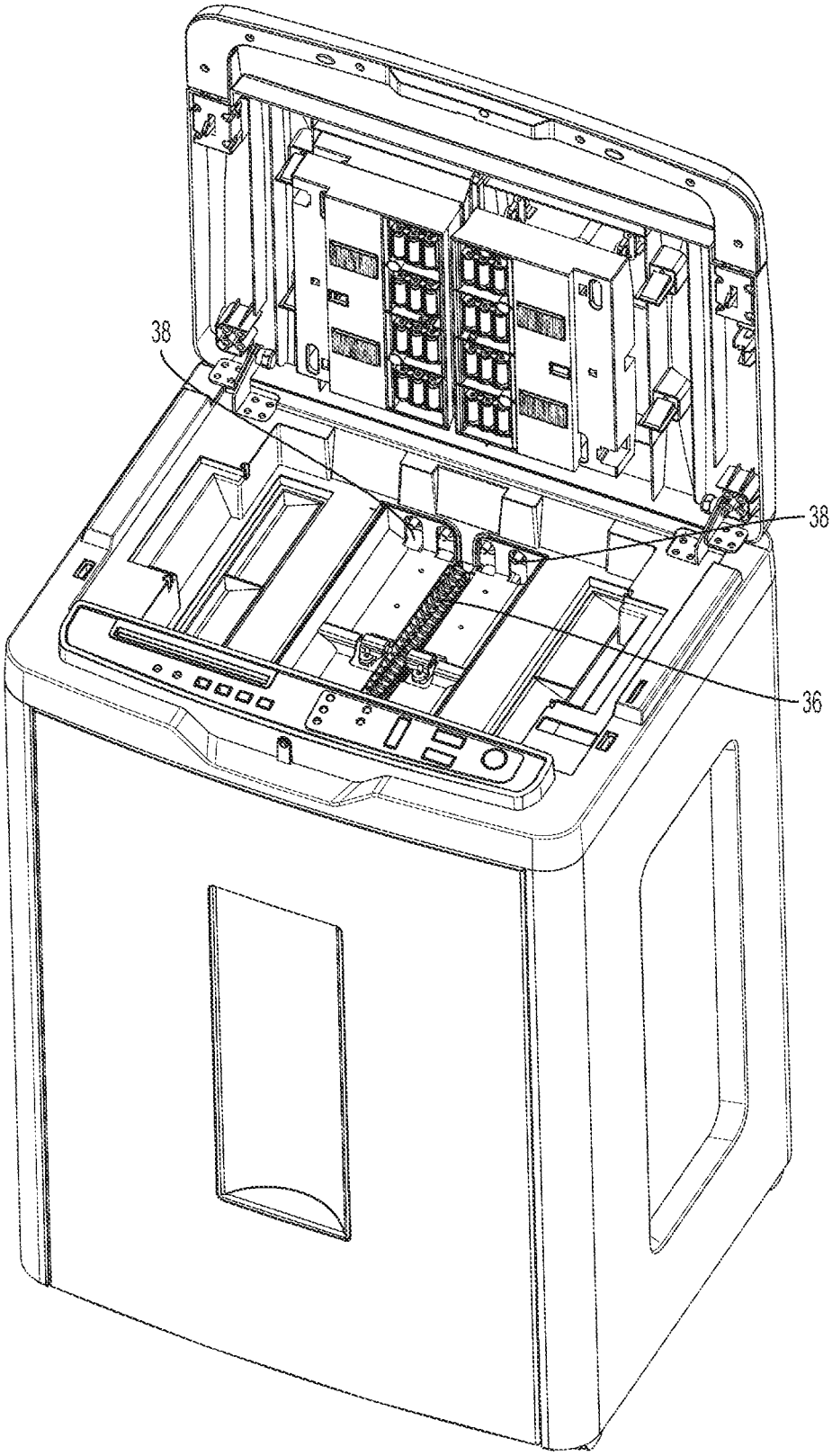
FIG. 3 is a drawing of the shredder of FIG. 1 with the roller belt assemblies removed.
Figure 4:
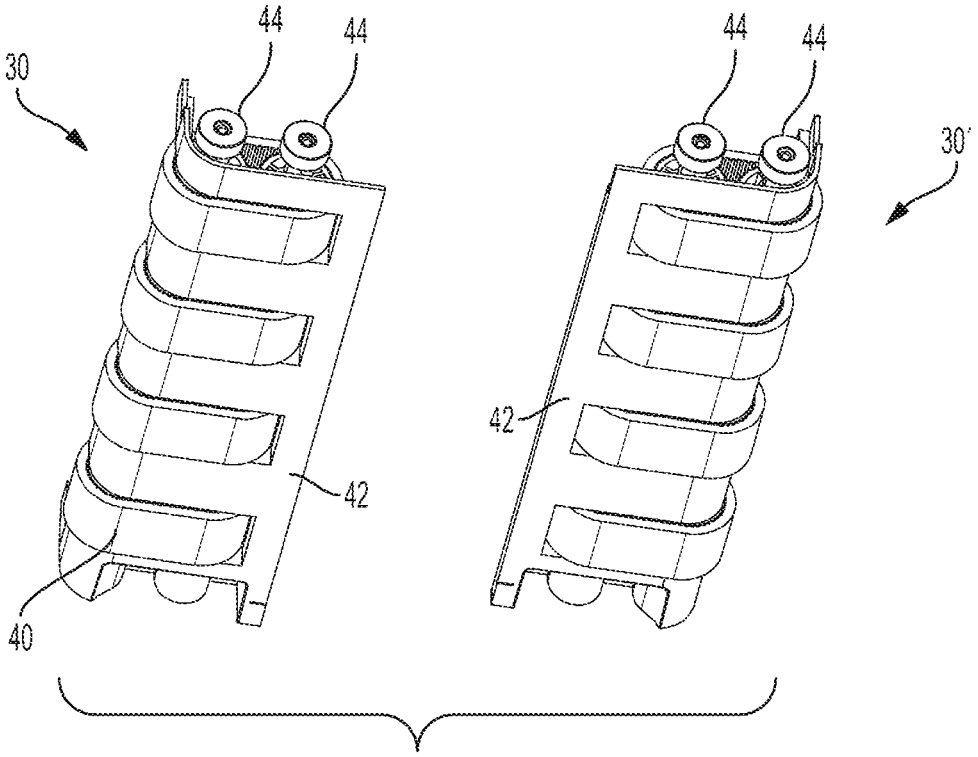
FIG. 4 is a close-up view of the roller belt assemblies.
Figure 9:
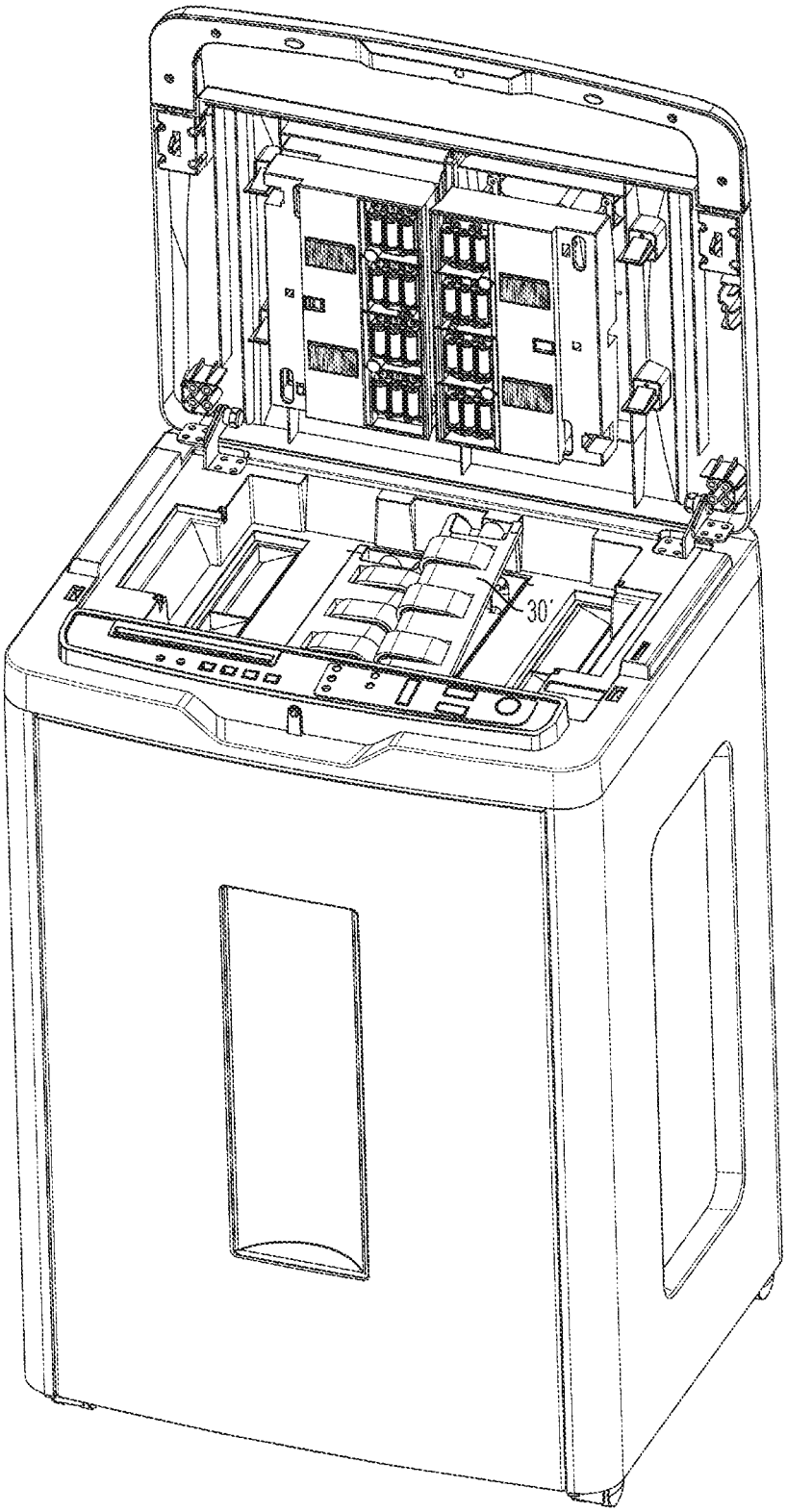
FIG. 9 is a view of the shredder of FIG. 2 showing a first step in the removal of the roller assemblies.
Figure 10:
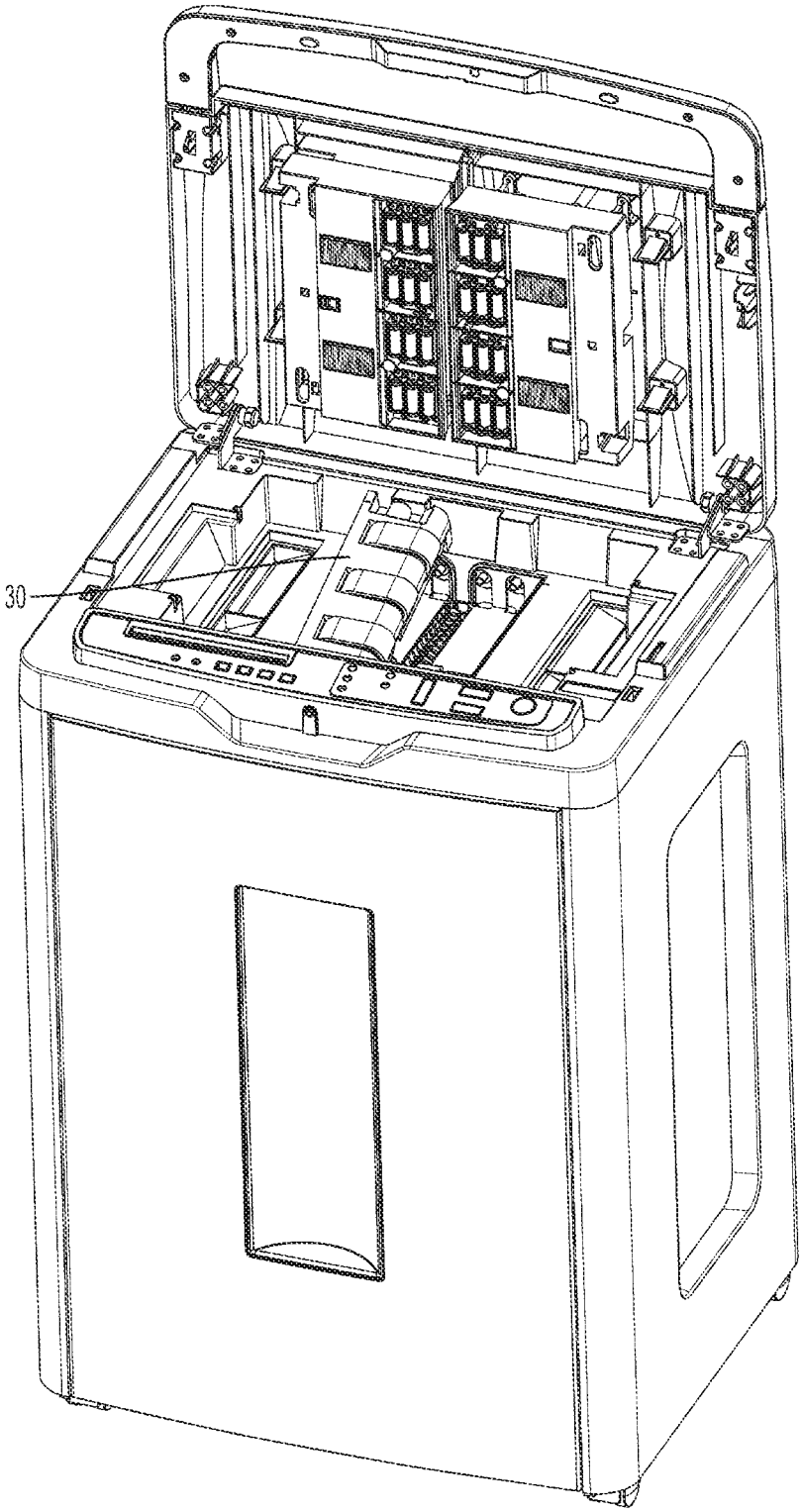
FIG. 10 is a view of the shredder of FIG. 2 showing a second step in the removal of the roller assemblies.

The roller belt assemblies 30, 30' are readily removable. FIG. 3 shows the shredder with the roller belt assemblies removed. This reveals the shredding blades 36 disposed immediately below the shredder mouth 28 as well as the mechanism that supports the roller belt assemblies 30, 30'. Drive shafts 38 interact with and drive the rollers (and indirectly the belts) in the roller belt assembly. FIGS. 9 and 10 show the steps in removing the roller belt assemblies 30, 30'. Removal is extremely easy. First one of the assemblies is grasped at its "top" end, the end nearest the hinges 26. The "top" end is lifted with the entire assembly pivoting up at an angle; then the "bottom" end can be pulled free from the mechanism. The cartridges are held in place by a simple detent mechanism (e.g., a ball fastener) although a mechanical latch can also be provided to prevent inadvertent removal of the cartridge. The drawings show the left-hand assembly 30' being removed first, but it does not matter in which order the assemblies are removed. FIG. 4 shows the two roller assemblies 30, 30' following removal. The assemblies are essentially mirror images of one another. Each of the drive wheels 44 at the top ends contacts one of the drive shafts 38 when the roller assemblies 30, 30' are inserted into the shredder. Roller belt assembly covers 42 provide a smooth surface to guide the paper into the shredder mouth 28. In the illustrated embodiment, the drive shafts 38 rotate the drive wheels 44 by means of friction. However, the shafts and wheels could be mating gears or other mechanical linkages could be employed as long as the linkage does not impede the ready removal of the roller belt assemblies.

Figure 5:
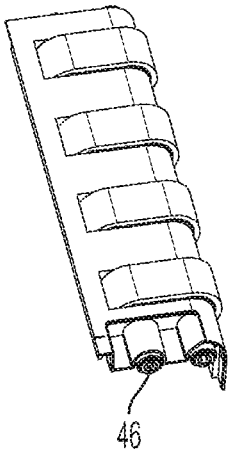
FIG. 5 is a top view of one of the roller assemblies.
Figure 6:
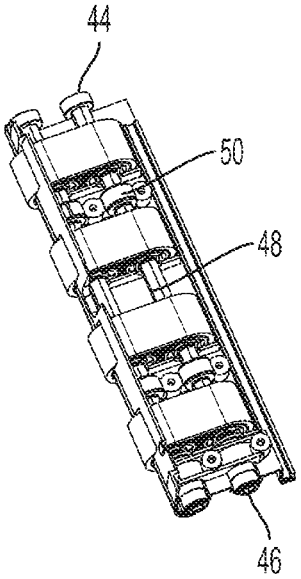
FIG. 6 is a bottom view of the roller assembly of FIG. 5.
Figure 7:
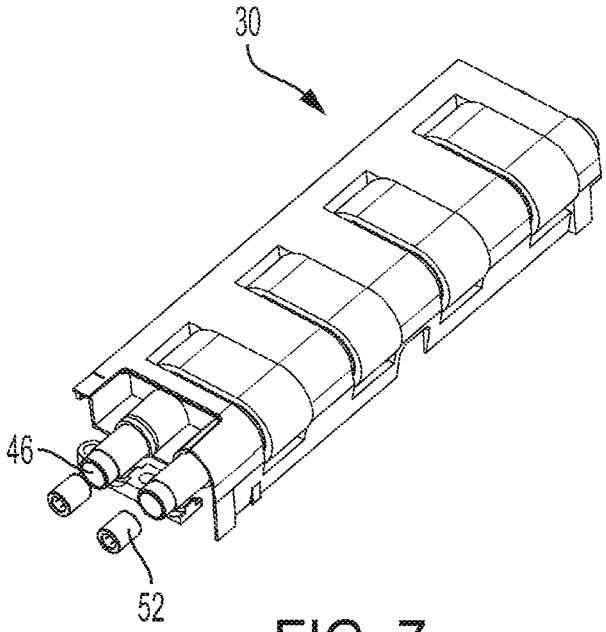
FIG. 7 is a top view of the roller assembly of FIG. 5 showing the terminal bearing connectors.
Figure 8:
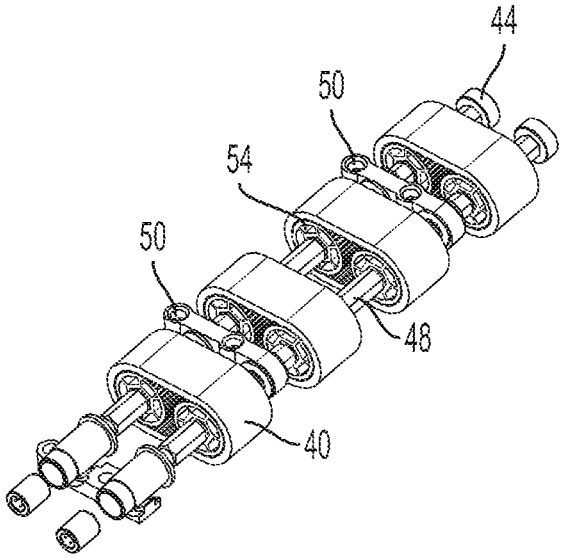
FIG. 8 is a bottom view of the roller assembly of FIG. 5 showing the terminal bearing connectors

FIG. 5 shows one of the roller assemblies 30 flipped up to show its bottom end revealing terminal bearing connectors 46. FIG. 6 shows a bottom view of the assembly showing the roller shafts 48 as well as the intermediate bearing holders 50. FIG. 8 shows the assembly with the cover 42 removed. The rollers 54 are apparent as well as the intermediate bearing holders 50. Each shaft 48 is supported by bearings within the bearing holders 50 so that the shaft rotates freely when the drive shaft 38 drives the wheel 44. When the shaft rotates, the rollers 54 which are affixed to the shaft 48 also rotate causing the belts 40 to move. In a preferred embodiment the rollers are toothed and the underside of the conveyor belt 40 bear matching teeth so that the rollers can drive the belts without slippage. The bearing connectors 46 grasp the terminal bearings 52 which are rotatingly affixed to the main shredder frame. That is, when the roller belt assembly 30, 30' is inserted into the unit, the connectors 46 slide over the bearings 52; the drive wheels 44 are then pressed downwards into contact with the drive shaft 38.

Figure 11:
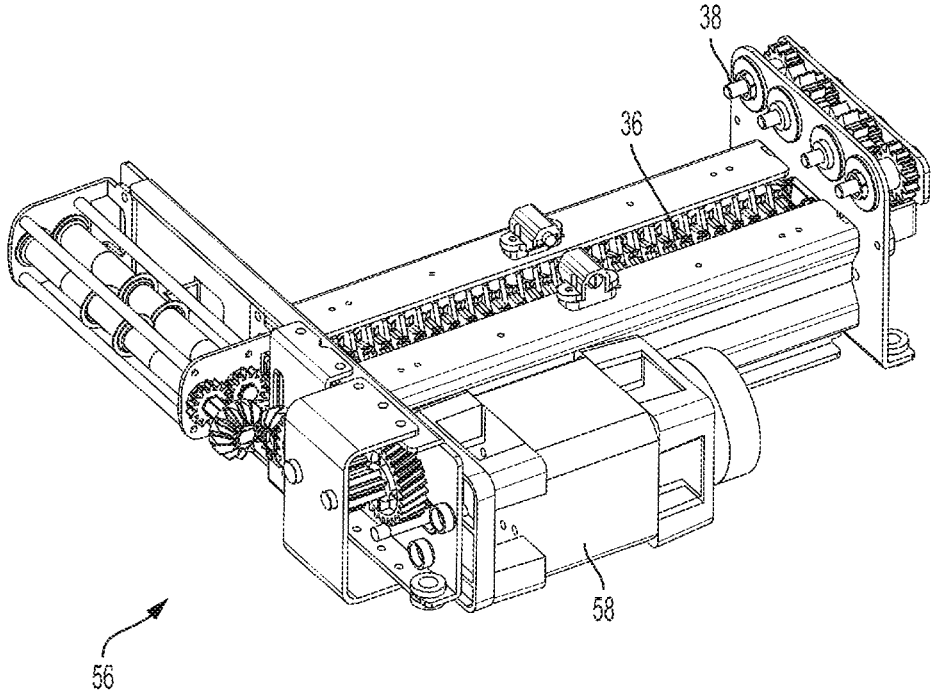
FIG. 11 is a view of the auto-feed shredder assembly with the roller assemblies removed.

This relationship is made more clear by reference to FIG. 11 which shows the shredder frame 56 removed from the shredder mechanism 16. A motor 58 drives shafts bearing blades 36. These shafts are also in mechanical communication with the drive shafts 38 so that when the shredder motor 58 operates the shredding blades 36, the drive shafts 38 also rotate and drive the roller belt assemblies 30, 30'. The terminal bearings 52 (not shown in this figure) are at the opposite ends of the roller belt assemblies 30, 30' from the drive shafts 38 and rotatingly support the ends of the roller assembly shafts 48.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. An auto-feed paper shredder comprising:

a shredding mechanism having a longitudinally disposed series of shredding blades;

a paper compartment for holding a stack of papers disposed above the shredding mechanism;

a feed slot in a lower surface of the paper compartment aligned with the longitudinally disposed series shredding blades;

at least one pair of removable conveyor feed belt cartridges, a first cartridge of said at least one pair of removable conveyor feed belt cartridges disposed on a first side of the feed slot and a second cartridge of said at least one pair disposed on a second side of the feed slot, wherein each removable conveyor feed belt cartridge contains one or more feed belts, and wherein the feed belts within the removable cartridges are powered so that the feed belts on the first side of the feed slot move towards the feed slot and the feed belts on the second side of the feed slot also move towards the feed slot;

a mechanical coupling that powers the feed belts of any removable cartridge that is inserted into said paper shredder when the shredding mechanism is operating; and a hinged door to close the paper compartment and apply pressure to the stack of papers.

2. The auto-feed paper shredder according to claim 1, wherein each removable cartridge includes four feed belts.

3. The auto-feed paper shredder according to claim 1, wherein the mechanical coupling is a frictional mechanical linkage.

4. The auto-feed paper shredder according to claim 1, wherein the hinged door has an input slot that aligns with the feed slot when the hinged door is in a closed position.

5. The auto-feed paper shredder according to claim 1, wherein said belts are powered by the same motor that powers the shredding blades.

6. The auto-feed paper shredder according to claim 1, wherein the belts are toothed and are driven by toothed rollers.

* * * * *